US005258268A

United States Patent [19]

Reuter et al.

[11] Patent Number: 5,258,268

[45] Date of Patent: Nov. 2, 1993

[54] PHOTOCHEMICALS WITH REDUCED DUST FORMATION

[75] Inventors: Karl-Heinz Reuter, Frechen; Manfred Reichrath, Renningen; Heinz Meckl, Bergisch, all of Fed. Rep. of Germany

[73] Assignee: Agfa Gevaert Aktiengesellschaft, Leverkusen, Fed. Rep. of Germany

[21] Appl. No.: 736,527

[22] Filed: Jul. 26, 1991

[30] Foreign Application Priority Data

Aug. 11, 1990 [DE] Fed. Rep. of Germany ..... 4025560

[51] Int. Cl.[5] ..... G03C 5/29

[52] U.S. Cl. ..... 430/458; 430/450; 430/465

[58] Field of Search ..... 430/458, 465, 450

[56] References Cited

U.S. PATENT DOCUMENTS

| | | | |
|---|---|---|---|
| 3,238,043 | 3/1966 | Levy | 430/458 |
| 3,833,377 | 9/1974 | Emoto et al. | 430/465 |
| 4,414,307 | 11/1983 | Kapecki et al. | 430/465 |
| 4,816,384 | 3/1989 | Fruge et al. | 430/465 |
| 4,923,786 | 5/1990 | Kuhnert et al. | 430/450 |
| 4,987,060 | 1/1991 | Marchesano | 430/465 |
| 5,085,963 | 2/1992 | Suzuki et al. | 430/106.6 |
| 5,135,840 | 8/1992 | Reuter et al. | 430/450 |

FOREIGN PATENT DOCUMENTS

| | | | |
|---|---|---|---|
| 70532 | 5/1982 | Japan | 430/465 |

OTHER PUBLICATIONS

Offenlegungashrift 35 15 440, and translation of patent claims, German Patent issued on Oct. 30, 1986.

*Primary Examiner*—Hoa Van Le

*Attorney, Agent, or Firm*—Connolly and Hutz

[57] ABSTRACT

Photographic processing chemicals in solid form containing the necessary active ingredients and auxiliary substances and in addition at least one compound corresponding to formula (I)

$$HO\text{-}(R\text{-}O)_n\text{-}H \quad (I)$$

wherein

R denotes $C_2$-$C_4$-alkyl and n denotes 1-200 or at least one compound corresponding to the following formula $$R_1\text{—}OH \quad (II)$$

wherein $R_1$ denotes $C_{10}$—$C_{18}$-alkyl or at least one water-soluble polymer, e.g. selected from polystyrene sulphonic acid and polyvinyl alcohol, or a mixture of at least two of the above mentioned compounds in a quantity of from 0.5 to 100 g/kg of solid substance are dust free or relatively dust free.

3 Claims, No Drawings

PHOTOCHEMICALS WITH REDUCED DUST FORMATION

INTRODUCTION

This invention relates to photochemicals formulated in solid form containing a reduced amount of dust and a process for their preparation.

BACKGROUND OF THE INVENTION

Photographic processing baths, e.g. development, bleaching and fixing baths, in most cases contain the required active ingredients at a low concentration and are therefore prepared by the user himself from water and chemical concentrates and optionally other auxiliary agents.

The concentrates should be as far as possible simple to dose and substantially dust-free, and packaging and transport should not entail unnecessarily high costs.

The liquid concentrates conventionally used in practice for the preparation of photographic baths ready for use have the advantage over the previously used pulverulent products that they do not give rise to dust and are not difficult to dissolve. The concentrates have the disadvantages of containing a high proportion by weight and volume of water and being packed in bulky packages which are difficult to dispose of.

Spray dried or freeze dried products according to DE-OS 37 33 861 which are intended to avoid these disadvantages have, however, the disadvantage of producing a large amount of dust.

SUMMARY OF THE INVENTION

It is therefore an object of the present invention to provide means for preparing photographic processing chemicals formulated as solids in which the proportion of dust is reduced, in other words which are dust-free or at least relatively dust-free. Further, the products thus prepared should be rapidly soluble in water.

It has now been found that this problem may be solved by the addition of small quantities of a hydrophilic organic compound to the solid components of photographic processing baths.

Formulations are described as dust-free or relatively dust-free if they contain little or no solid components having a particle size of <0.1 mm. The quantity is determined by conventional sieve analysis and should preferably be below 2% by weight, in particular below 1% by weight.

This invention therefore relates to photographic processing chemicals formulated as solids containing the required active ingredients and auxiliary substances, characterised in that they contain, in addition, at least one compound corresponding to formula (I)

$$HO\text{-}(R-O)_n\text{-}H \qquad (I)$$

wherein

R denotes $C_2$-$C_4$-alkyl and n denotes 1-200 or at least one compound corresponding to the following formula $$R_1\text{—}OH \qquad (II)$$

wherein $R_1$ denotes $C_{10}$–$C_{18}$-alkyl, or at least one water-soluble polymer, e.g. selected from polystyrene sulphonic acid and polyvinyl alcohol, or a mixture of at least two of the above-mentioned compounds in a quantity of from 0.5 to 100 g/kg of solid, preferably from 5 to 20 g/kg of solid.

Suitable compounds corresponding to formula I include ethylene glycol, homologues of ethylene glycol and polyethylene glycols having average molar masses of from 200 to 10,000 and propylene glycol and polypropylene glycols having average molar masses of from 200 to 10,000, preferably polyethylene glycols having average molar masses of from 300 to 1000, e.g. polyethylene glycol 300, 400, 600 and 1000, briefly referred to as P 300, P 400, P 600, P 1000.

Suitable compounds corresponding to formula II include fatty alcohols such as 1-dodecanol and fatty alcohol mixtures e.g. a mixture of equal parts of $C_{12}$-and $C_{14}$-fatty-alcohol.

Suitable photographic processing chemicals include black-and-white developers, colour developers, bleaching agents, fixatives, bleach fixatives and stabilizers.

These photographic processing chemicals contain the usual active ingredients and auxiliary substances in addition to the additive according to the invention. Details will be found in the examples of embodiments.

DETAILED DESCRIPTION

The process for the preparation of the dust-freed products according to the invention is characterised in that active ingredients and auxiliary substances of a photographic processing bath are mixed together with the addition of at least one compound corresponding to formula (I) until the components are homogeneously distributed. This may be achieved by mechanical mixing in a conventional "Lödige Mixer", "Nauta Mixer" or "Tumbler Drier" or by the production of air turbulence accompanied by spraying. The formulations thus prepared are dust-free or relatively dust-free, freely pourable and rapidly soluble, have a virtually unlimited shelf life and when subjected to mechanical stresses, e.g. when packaged by means of dosing screws, they undergo little or no abrasion but any abrasion dust that is formed is immediately bound.

It is possible and sometimes necessary to treat the individual components of a photographic processing bath separately by the process according to the invention and then to mix them together or to keep them separate until the processing bath is prepared; for example, for a colour photographic development bath, the developer, the alkali donor and the oxidation protective agent are treated separately and only combined for preparation of the developer solution. The other additives, such as water softener, heavy metal complex former, sodium sulphite and alkali metal halide, may be mixed and treated together with one or more of the essential components.

EXAMPLE 1

(Dust binding of potash)

1000 g of potash are sprayed for 3.5 minutes with 20 g of a substance according to the invention or the indicated quantity of substance in a turbulent air stream.

| Substance | Ethylene glycol | Dipropylene glycol | P 300 | P 400 | P 600 |
|---|---|---|---|---|---|
| Dust content before | 14.7 | 14.7 | 14.7 | 14.7 | 14.7 |
| Dust content after (in % | 11.2 | 10.9 | 3.0 | 0.6 | 0.04 |

-continued by weight)

| Substance Quantity of substance | Fatty alcohol mixture 60 ml | 10% by wt. aqueous polystyrene sulphonic acid 60 ml | 7.5% by wt. aqueous polyvinyl alcohol 70 ml |
|---|---|---|---|
| Dust content before | 14.7 | 14.7 | 14.7 |
| Dust content after (in % by wt.) | 0.1 | 0.8 | 3.0 |

EXAMPLE 2

(Stabilizing bath replenisher)

The following chemicals are sprayed with 2 g of P 600 in a turbulent stream for 3 minutes:

| | |
|---|---|
| Sodium disulphite | 20 g |
| Sodium benzoate | 10 g |
| Disodium salt of 1-hydroxyethane-1,1-diphosphonic acid | 43 g |
| Sodium hexametaphosphate | 20 g |
| Potassium hydrogen sulphate | 4 g |
| Dust content before: | 45.9% by weight |
| Dust content after: | 1.3% by weight. |

EXAMPLE 3

(Potassium disulphite)

1000 g of potassium disulphite are mixed with 20 g of P 300 in a Lödige mixer for 5 minutes. The distribution is then homogeneous.

| | |
|---|---|
| Dust content before: | 23.7% by weight |
| Dust content after: | 4.7% by weight |

EXAMPLE 4

(Bleach fixing bath replenisher)

The following chemicals are mixed with 0.5% by weight of P 600 (based on the total solids content) in a tumbler drier for 5 minutes:

| | |
|---|---|
| Ammonium thiosulphate | 750 g |
| Sodium disulphite | 88 g |
| Sodium sulphate | 63 g |
| Sodium-iron-EDTA | 657 g |
| EDTA acid | 8 g |
| Dust content before: | 2.4% by weight |
| Dust content after: | 0.01% by weight |

EXAMPLE 5

(film developer replenisher)

a) Alkali content

The following chemicals are mixed with 2% by weight of P 600 (based on the total solids content) in a turbulent stream for 3 minutes:

| | |
|---|---|
| Potash | 35 g |
| Potassium bromide | 0.5 g |
| Sodium sulphite | 4.85 g |
| Caustic soda | 1.1 g |
| Dust content before: | 13% |
| Dust content after: | 0.8% |

b) Developer component

The colour developer CD-4 is mixed with 1% by weight of P 600 (based on the total weight) in a turbulent stream for 3 minutes.

| | |
|---|---|
| Dust content before: | 1.2% |
| Dust content after: | 0.0% |

c) Hydroxyl ammonium sulphate (HX)-diethylene triamine-pentacetic acid (DTPA) mixture The following substances are mixed with 1% by weight of P 600 (based on the total weight) in a turbulent stream for 3 minutes.

| | |
|---|---|
| DTPA | 280 g |
| HX | 260 g |
| Dust content before: | 3.0% |
| Dust content after: | 0.0%. |

What is claimed is:

1. Chemicals formulated as solids for the processing of silver-containing photographic elements, containing the necessary active ingredients and auxiliary substances including at least one compound corresponding to formula (I)

$$HO\text{-}(R-O)_n\text{-}H \qquad (I)$$

wherein

R denotes $C_2$—$C_4$-alkyl and n denotes 1–200 in a quantity of from 0.5 to 100 g/kg of solids.

2. Chemicals formulated as solids according to claim 1, characterised in that they contain at least one polyethylene glycol having an average molar mass of from 300 to 1000.

3. Chemicals formulated as solids according to claim 1, characterised in that they contain less than 2% by weight of solid components having a particle size of <0.1 mm.

* * * * *